US009097075B2

(12) United States Patent
Lin

(10) Patent No.: US 9,097,075 B2
(45) Date of Patent: Aug. 4, 2015

(54) CUTTING ELEMENT STRUCTURE WITH SLOPED SUPERABRASIVE LAYER

(75) Inventor: Yuanbo Lin, Lewis Center, OH (US)

(73) Assignee: Diamond Innovations, Inc., Worthington, OH (US)

( * ) Notice: Subject to any disclaimer, the term of this patent is extended or adjusted under 35 U.S.C. 154(b) by 632 days.

(21) Appl. No.: 13/288,154

(22) Filed: Nov. 3, 2011

(65) Prior Publication Data

US 2012/0103700 A1 May 3, 2012

Related U.S. Application Data

(60) Provisional application No. 61/409,747, filed on Nov. 3, 2010.

(51) Int. Cl.

| | |
|---|---|
| ***E21B 10/36*** | (2006.01) |
| ***E21B 10/567*** | (2006.01) |
| ***E21B 10/573*** | (2006.01) |
| ***E21B 10/56*** | (2006.01) |
| *B22F 7/06* | (2006.01) |
| *C22C 26/00* | (2006.01) |

(52) U.S. Cl.

CPC ..... *E21B 10/5676* (2013.01); *E21B 10/56* (2013.01); *E21B 10/5673* (2013.01); *E21B 10/573* (2013.01); *E21B 10/5735* (2013.01); *B22F 7/06* (2013.01); *C22C 26/00* (2013.01)

(58) Field of Classification Search

CPC ... E21B 10/573; E21B 10/5735; E21B 10/56; E21B 10/567; E21B 10/5673; E21B 10/5676; C22C 26/00; B22F 7/06

USPC ..... 175/428, 430, 431, 432, 434

See application file for complete search history.

(56) References Cited

U.S. PATENT DOCUMENTS

| | | | | |
|---|---|---|---|---|
| 5,028,177 | A | 7/1991 | Meskin | |
| 5,486,137 | A | 1/1996 | Flood et al. | |
| 5,494,477 | A | 2/1996 | Flood et al. | |
| 6,068,071 | A * | 5/2000 | Jurewicz | 175/432 |
| 6,131,678 | A * | 10/2000 | Griffin | 175/434 |
| 7,316,279 | B2 | 1/2008 | Wiseman et al. | |
| 2001/0004026 | A1 * | 6/2001 | Lockstedt et al. | 175/431 |
| 2007/0119631 | A1 | 5/2007 | Eyre | |
| 2008/0178535 | A1 | 7/2008 | Wan | |
| 2012/0048625 | A1 * | 3/2012 | Bellin | 175/430 |

FOREIGN PATENT DOCUMENTS

| | | | |
|---|---|---|---|
| EP | 0638383 | A1 | 2/1995 |
| GB | 2323110 | A | 9/1998 |

* cited by examiner

*Primary Examiner* — Jennifer H Gay
*Assistant Examiner* — George Gray
(74) *Attorney, Agent, or Firm* — Keith G. DeMaggio

(57) ABSTRACT

A superabrasive compact cutting element, for example, a insert utilized in shear cutter bits. The cutting elements include a layer of superabrasive materials that is provided with different shapes and positions relative to the substrate in order to enhance the abrasion resistance performance of the cutting element. The cutting element includes a top, bottom and peripheral surface. The cutting element further includes at least one superabrasive material portion comprising polycrystalline diamond (PCD) or cubic boron nitride (CBN), a substrate supporting the at least one superabrasive material portion, and an interface where the at least one superabrasive material portion and the substrate are joined. The interface slopes downwardly with a slope angle of less than about 40° and/or the cutting element has a longitudinal thickness of the at least one superabrasive material portion measured along a peripheral surface of the cutting element in a longitudinal direction greater than about 3 mm.

26 Claims, 11 Drawing Sheets

FIG. 12
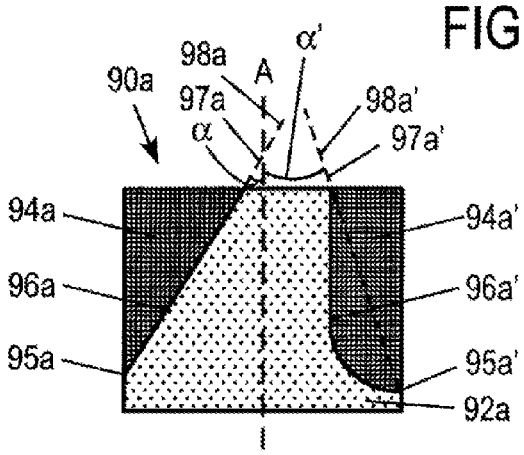
FIG. 12a
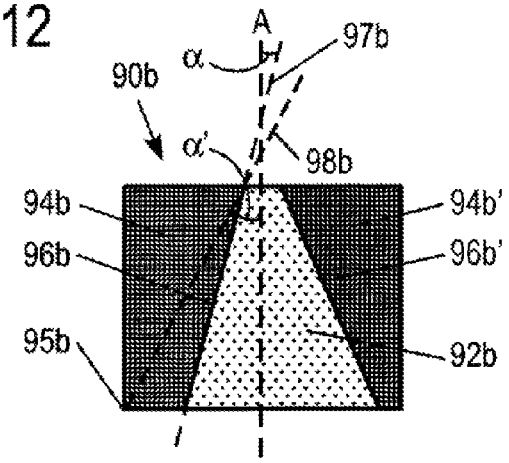
FIG. 12b
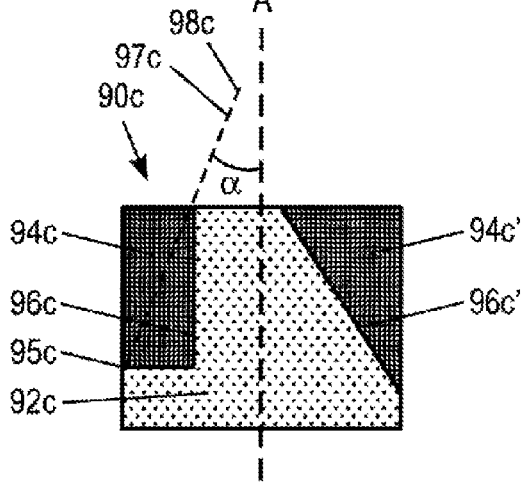
FIG. 12c
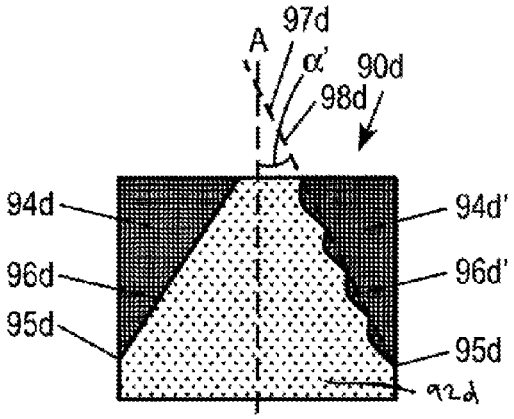
FIG. 12d FIG. 13A (Prior Art)
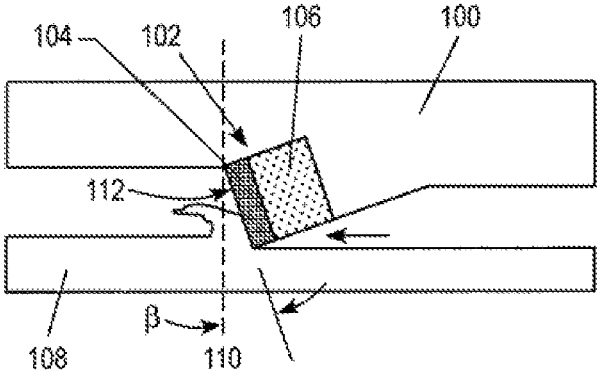
FIG. 13B (Prior Art)
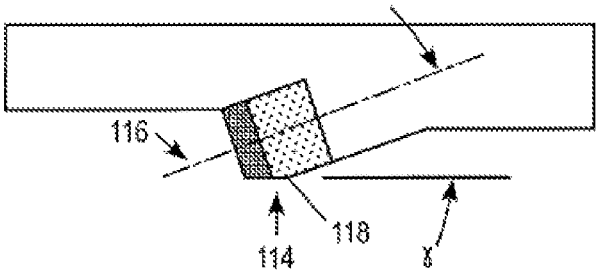
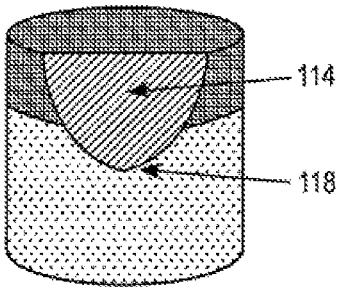
FIG. 14 (Prior Art)

CUTTING ELEMENT STRUCTURE WITH SLOPED SUPERABRASIVE LAYER

TECHNICAL FIELD AND INDUSTRIAL APPLICABILITY

The present disclosure relates to superabrasive compact cutting elements, for example, cutters utilized in shear cutter bits or other rotary cutting tools. More specifically, the cutting elements include a layer of superabrasive materials, also referred to as a table, which is provided with different shapes and positions relative to the substrate in order to enhance the abrasion resistance performance of the cutting element. The disclosure also relates to a shear cutter bit including at least one cutting element.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Currently available cutting elements utilized in shear cutter bits use superabrasive materials having Knoop hardness greater than 2000 such as, but not limited to, single crystal diamond, polycrystalline diamond (PCD), thermally stable polycrystalline diamond, CVD diamond, metal matrix diamond composites, ceramic matrix diamond composites, nanodiamond, cubic boron nitride, and combinations of superabrasive materials. The superabrasive layer or table is supported by or joined coherently to a substrate, post or stud that is generally made of cobalt tungsten carbide (Co—WC). The overall shape is generally cylindrical. The relative position of the diamond table to the Co—WC stud is directly on the top. From the side view of the overall structure is a layered structure with the diamond table forming the top portion and the Co—WC stud forming the bottom portion.

FIG. 13A is an example of a traditional shear cutter bit 100 including at least one traditional cutting element 102 that includes a superabrasive material 104 and a substrate 106. The cutting element 102 is brazed or pressed into the shear cutter bit 100 for subterranean formation drilling. The cutting element 102 is mounted into the shear cutter bit 100 at a certain angle which is called the back-rake angle β. The back-rake angle β is the angle between the shear cutter bit axis 110 and the front surface 112 of the superabrasive material. The back-rake angle in many shear cutter bits is between about 15° and about 25°, but can be as high as 30° or even 45°.

As illustrated in FIG. 13A, the cutting element will plow and shear the bottom of the hole in the subterranean formation 108 during the cutting operation. As illustrated in FIG. 13B, after a certain period of drilling, the cutting element will generally have a wear pattern or wear surface 114 with a wear angle γ that is approximately equal to the back-rake angle β. The wear angle γ is the angle between the cutting element longitudinal axis 116 and the wear surface 114.

FIG. 14 illustrates a top perspective view of the cutting element 102 after it has been removed from the shear cutter bit 100, because of wear. The wear surface 114 extends into the substrate 106 at the wear surface bottom 118.

Cutting element abrasion resistance performance can be measured by Vertical Turret Lathe with Coolant (VTL-c) testing in which a granite log is machined by a cutting element The abrasion resistance performance is graphically presented with the cutting element wear volume plotted on the vertical axis and the linear distance the cutting element has traveled through the granite log along the horizontal axis. Plots of VTL-c testing results for traditional cutting elements have an inflection when the cutter element wear volume begins to accelerate quickly in relation to the linear distance. Further, it has been determined that the inflection generally correlates to the event when the wear surface (114) extends beyond the superabrasive table and beyond the interface between the superabrasive material and substrate. It appears the inflection develops because the heat generated by the friction of the substrate, especially Co—WC, against the rock in the subterranean hole degrades or damages the superabrasive material and makes the cutting element more vulnerable to abrasion failure.

It has further been determined that the inflection and accelerated cutter insert wear can be delayed by increasing the thickness of the superabrasive material. However, simply increasing the thickness of the superabrasive table leads to increased stress in the superabrasive material from the thermal expansion coefficient mismatch with the Co—WC substrate during and after the high pressure high temperature (HPHT) sintering process. The thermal expansion coefficient mismatch can lead to failure of the superabrasive material from horizontal cracks or delamination. In particular, commercial cutting elements have a superabrasive material limited to no more than 3 millimeters thick to avoid the delamination and failure concerns.

SUMMARY

The disclosed cutting elements increase the abrasion resistance or cutting life of cutting elements by the adoption of a structure that differs from the traditional layered structure of an upper superabrasive material layer covering a lower substrate. The disclosed cutting elements will postpone or eliminate the commencement of the inflection observed in VTL-c testing by avoiding contact between the substrate and the surface to be cut. During drilling, only the superabrasive material contacts the surface to be cut, and the superabrasive layer does not suffer the disadvantageous stress caused failures faced by thick superabrasive layer designs.

A first aspect of the invention relates to a cutting element including a top surface, a bottom surface, and a peripheral surface connecting the top and bottom surface, and a longitudinal axis passing through the center of the cutting element. The cutting element further includes at least one superabrasive material portion, a substrate supporting the at least one superabrasive material portion, and an interface where the at least one superabrasive material portion and the substrate are joined. The interface slopes downwardly in relation to the top surface such that the interface forms a slope angle, which is the least possible angle between the longitudinal axis and a line contained within a slope plane that is less than about 40°.

The slope plane is a plane that contacts the interface at least at three non-collinear points and also has substrate located on only one side of the plane, or, where there is no plane that contacts the interface at least at three non-collinear points and also has substrate located on only one side of the plane, the slope plane is the tangent plane that incorporates a point along the peripheral surface having the greatest longitudinal peripheral thickness.

A second aspect of the invention relates to a cutting element including a top surface, a bottom surface, a peripheral surface connecting the top and bottom surface, and a longitudinal axis running perpendicular to the top and bottom surface. The cutting element further includes at least one superabrasive material portion, and a substrate supporting the at least one superabrasive material portion. A longitudinal thickness of the at least one superabrasive material portion measured along the peripheral surface of the cutting element in the longitudinal direction is greater than about 3 mm.

A third and fourth aspect of the invention each relate to a shear cutter bit for subterranean drilling including at least one cutting element according to the first or second aspect, respectively.

It is to be understood that both the foregoing general description and the following detailed description are exemplary and explanatory and are intended to provide further explanation of the invention as claimed.

BRIEF DESCRIPTION OF THE DRAWINGS

The following detailed description can be read in connection with the accompanying drawings in which like numerals designate like elements and in which:

FIGS. 12*a*-12*g* show cross-sectional views of cutting elements according to yet further embodiments of the invention.

FIG. 13A shows a shear cutter bit with a traditional cutting element during a cutting operation.

FIG. 13B shows a shear cutter bit with a traditional cutting element after a certain period of wear has occurred.

FIG. 14 shows a traditional cutting element after a certain period of wear has occurred.

DETAILED DESCRIPTION

Definitions

Figure 1:
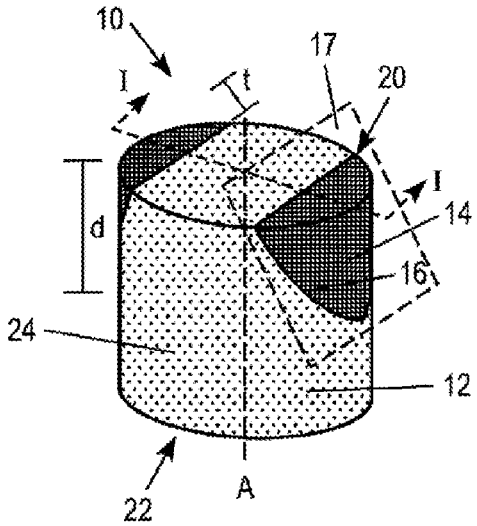
FIG. 1 shows a top perspective view of a cutting element according to an embodiment of the invention that includes a phantom slope plane.

Unless defined otherwise, all technical and scientific terms used herein generally have the same meaning as commonly understood by one of ordinary skill in the art to which this invention belongs.

As used herein, each of the following terms has the meaning associated with it in this section.

As used herein, "longitudinal axis" refers to the cylindrical axis running through the center of the cutting element in the longitudinal direction.

As used herein, "cylinder" refers to any body of rotation with a single rotational axis.

As used herein, "interface" refers to the interface between the superabrasive material portion and the substrate.

As used herein, "peripheral surface" refers to the outer surface of the cutting element connecting the top and bottom surfaces.

As used herein, "longitudinal peripheral thickness" refers to the thickness of a material measured in the longitudinal direction along the peripheral surface of the cutting element. For example, the longitudinal peripheral thickness of the superabrasive material would be the thickness of the superabrasive material measured in the longitudinal direction along the peripheral surface of the cutting element.

As used herein, "superabrasive material thickness" refers to the thickness of the superabrasive material portion. The thickness of the superabrasive material is measured at any given location along the interface by measuring the shortest distance within the superabrasive material only from that location along the interface to an outer surface of the cutting element. As used herein, the "greatest superabrasive material thickness" refers to the thickness of the superabrasive material portion at the location along the interface that has the greatest superabrasive material thickness when measured in accordance with the method above.

As used herein, "cross-section plane" refers to a plane slicing the cutting element that incorporates the longitudinal axis and a point along the peripheral surface having the greatest longitudinal peripheral thickness of superabrasive material.

As used herein, "slope plane" refers to a plane that contacts the interface at least at three non-collinear points on the interface and does not cut through any part of the substrate, or, where there is no plane that contacts the interface at least at three non-collinear points and also has substrate located on only one side of the plane, the slope plane is the tangent plane that incorporates a point along the peripheral surface having the greatest longitudinal peripheral thickness.

As used herein, "slope line start point" refers to a point on the peripheral surface having the greatest longitudinal peripheral thickness of the superabrasive material.

As used herein, "slope line" refers to the line in a plane incorporating the longitudinal axis that starts at the slope line start point and also intersects the interface line at least at one location other than the slope line start point such that the substrate is located on only one side of the line.

As used herein, "slope angle" refers to the least possible angle between the longitudinal axis and a line contained by the slope plane. Further, if more than one slope plane is present, then the slope angle is the least of the possible slope angles.

As used herein, "slope line angle" refers to the angle formed between the slope line and the longitudinal axis.

Description

Disclosed are embodiments of an improved cutting element, including, for example, a superabrasive cutting element used in earth boring shear cutter bits or other rotary cutting tools. The improved cutting element contains, among other improvements, better cutting element life and abrasion resistance. Specifically, the improved cutting element can postpone or eliminate the point where the volume wear ratio begins to accelerate when compared to the linear distance cut by the cutting element. Without being bound to any particular theory, it is believed that this is accomplished because the specific shapes and positioning of the superabrasive material in relation to the substrate helps to avoid contact of the substrate with the material to be cut during use and wear of the cutting elements.

Figure 2:
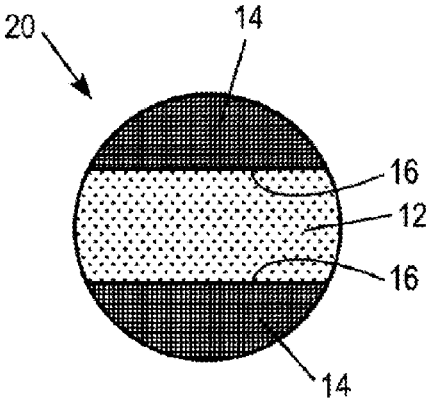
FIG. 2 shows a top view of the cutting element of FIG. 1.
Figure 3:
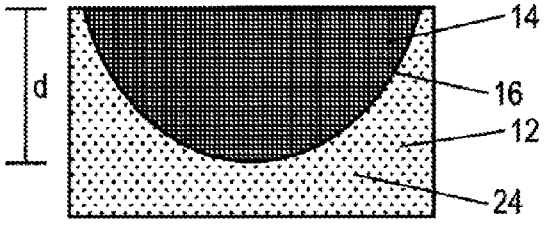
FIG. 3 shows a side view of the cutting element of FIG. 1.

In a first embodiment illustrated in FIGS. 1-3, a cutting element 10 includes a substrate 12 and at least one superabrasive material portion 14. The superabrasive material portions 14 are joined to the substrate 12 at interfaces 16. The cutting element 10 includes a top surface 20, bottom surface 22, and peripheral surface 24. A longitudinal axis A runs perpendicular to the top and bottom surfaces (20, 22) of the cutting element. The substrate extends from the bottom surface 22 to the top surface 20 in the center and at least at two opposing portions of the peripheral surface 24. In this manner, the center portion and two opposing side portions of the top surface 20 of the cutting element include uncovered substrate. The superabrasive material portions 14 are located on opposing portions of the peripheral surface 24 of the cutting element. Because the superabrasive material portions 14 are joined to the substrate at an interface that slopes downwardly and outwardly from the top surface 20 with respect to the longitudinal axis 26, the superabrasive material portion covers the substrate at two opposing side portions of the top surface 20. A slope plane 17 is present in FIG. 1 where the plane contacts the interface 16 at three non-collinear points, where the substrate 12 is located on only one side of the plane.

Figure 1A:
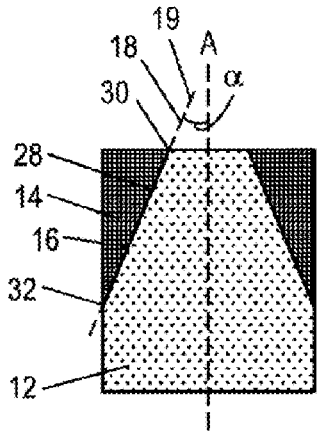
FIG. 1A shows a cross-section of the cutting element of FIG. 1 cut along line I-I.

Each of the interfaces 16 in FIG. 1 slope downwardly and outwardly from the top surface 20 to the peripheral surface 24. FIG. 1A is a cross-section of the cutting element of FIG. 1 cut along line I-I. The interface 16 forms a slope angle $\alpha$ with respect to the longitudinal axis A. The slope angle $\alpha$ is the least possible angle between the longitudinal axis and a line contained within the slope plane 17. FIG. 1A shows the line 19 contained within the slope plane having the least possible angle with the longitudinal axis.

The cutting element 10 also has a slope line angle that is equal to the slope angle. The slope line angle is determined based on the angle of a slope line 18 with respect to the longitudinal axis A. The slope line 18 extends from a slope line start point 32 along the interface 16. In this manner, the substrate 12 is only present on the downward side of the slope line 18. The slope line start point 32 is the point where the interface 16 intersects the peripheral surface where the superabrasive material has its greatest longitudinal peripheral thickness (d).

In certain embodiments, the slope angle $\alpha$ is less than about 40°. In more certain embodiments, the slope angle $\alpha$ is about 39° or less. In yet more certain embodiments, the slope angle is about 35° or less, 30° or less, or 25° or less. Further, in specific embodiments, the slope angle is greater than about 1°. In more specific embodiments, the slope angle is greater than about 5°. In yet more specific embodiments, the slope angle is about 15° or greater.

Furthermore, it is possible to set the slope angle $\alpha$, for any of the embodiments, based on the anticipated wear patterns of the cutting element. For example, when a cutting element is used as a cutter insert in a shear cutter bit for subterranean formation drilling, the cutting element is mounted into the shear cutter bit at a certain back-rake angle, which is the angle between the drill bit axis and the front surface of the cutting element. As illustrated in FIG. 13B, during extended use as a cutting element during shear cutter drilling, the cutting element wears along a wear angle $\gamma$, which is the angle between the cutter insert axis and wear surface. Further, as illustrated in FIG. 13B, the wear angle $\gamma$ is approximately equal to the back-rake angle $\beta$. Therefore, in certain embodiments, in order to maximize the contact between the superabrasive material portion and the material to be cut during wear of the cutting element, the slope angle $\alpha$ may be approximately equal to the anticipated back-rake angle. Many cutting elements are mounted to shear cutter bits with a back-rake angle of from about 15° to about 25°, and thus, in certain embodiments, the slope angle $\alpha$ is from about 15° to about 25°.

Although wear patterns for the cutting element should be considered when setting the slope angle, other factors may contribute to angles that differ from the back-rake angle. For example, the strength of the bond between the superabrasive material and substrate, optimizing the reduction of stresses within the superabrasive material during cutting, and ease of manufacture would all contribute to the optimal slope angle.

In certain embodiments, the superabrasive material portion has Knoop hardness greater than 2000 as found in, but not limited to, single crystal diamond, polycrystalline diamond (PCD), thermally stable polycrystalline diamond, CVD diamond, metal matrix diamond composites, ceramic matrix diamond composites, nanodiamond, cubic boron nitride, and combinations of superabrasive or other superabrasive material used in superabrasive cutting elements. In more certain embodiments, the superabrasive material portion includes a sintered polycrystalline diamond with a binder material. Exemplary binder elements include metals such as cobalt, nickel, iron, or an alloy containing one or more of these metals as well as metalloids such as silicon. The binder elements may further include any known additives used in the binder phase of superabrasive materials.

The binder material may remain in the diamond layer within the pores existing between the diamond grains or may be removed, and optionally replaced, by another material, as known in the art, to form a so-called thermally stable diamond. The binder is removed by leaching or the diamond table is formed with silicon, a material having a coefficient of thermal expansion similar to that of diamond. Variations of this general process exist in the art.

Further, in certain embodiments, the substrate may be any material suitable to support the superabrasive table in the use application. For subterranean shear cutter bits, the substrate includes hard metal carbides. Exemplary carbides include tungsten carbide, titanium carbide, or tantalum carbide, or combinations thereof. A particular carbide for use as a substrate is tungsten carbide. In more certain embodiments, the substrate further includes a binder such as cobalt, nickel, iron, or an alloy containing one or more of these metals as well as metalloids such as silicon. The binder elements may further include any known additives used in the binder phase of carbide studs. The substrate may further include minor percentages of cubic carbides, for example, niobium carbide, vanadium carbide, hafnium carbide, chromium carbide, and zirconium carbide.

Another advantage to a downwardly sloping slope angle is that a larger portion of the peripheral surface 24 is formed of superabrasive material without increasing the thickness of the superabrasive material portion 14 of the cutting element. One possible solution for increasing the time during use as a cutter insert on a shear cutter bit or other rotary tool in which only the superabrasive material is in contact with the material to be cut, is to increase the thickness of the superabrasive material layer on the top surface of a cutting element. However, there are disadvantages to using a thicker superabrasive material. For example, as the superabrasive material becomes thicker there is increased stress within the superabrasive material due to the thermal expansion coefficient mismatch with the substrate, which often leads to failure from horizontal cracks or delamination.

Downwardly sloping slope angles provide cutting elements where the longitudinal peripheral thickness (d), which is the thickness of the abrasive material portion measured in the longitudinal direction along the peripheral surface of the cutting element, is greater than the greatest abrasive material thickness (t), which is measured according to its definition above. As illustrated in the first embodiment of FIG. 1, the longitudinal peripheral thickness (d) along the peripheral surface 24 from the top surface 20 to the interface 16 is substantially greater than the greatest abrasive material thickness (t) of the superabrasive material portion 14.

In certain embodiments, the longitudinal peripheral thickness along the peripheral surface in the longitudinal direction from the top surface to the interface is greater than about 3 mm. In more certain embodiments, the distance is about 4 mm or greater. In yet more certain embodiments, the distance is about 5 mm or greater. Also, in certain embodiments, the longitudinal peripheral thickness to greatest abrasive material thickness ratio (d/t) is greater than about 1.5. In more certain embodiments, the ratio is about 2 or greater. In yet more certain embodiments, the ratio is about 2.5 or greater. In still more certain embodiments, the ratio is about 3 or greater.

Figure 4:
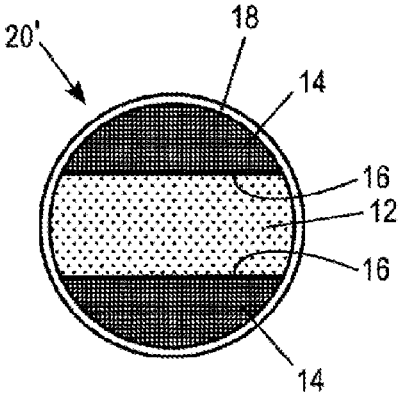
FIG. 4 shows a top view of a cutting element according to a second embodiment of the invention.
Figure 5:
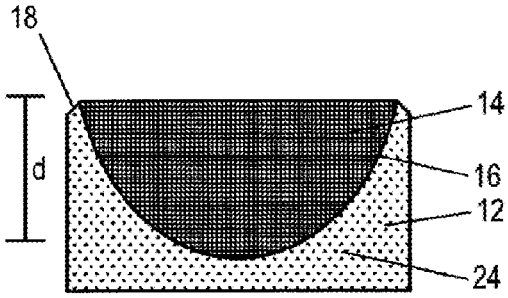
FIG. 5 shows a side view of the cutting element of FIG. 4.

The first embodiment illustrated in FIGS. 1-3 has a straight edge where the peripheral surface 24 meets the top surface 20. However, in a second embodiment, the edge may be beveled to form a chamfer. Such an embodiment is illustrated in FIGS. 4-5, which is similar to the first embodiment except for the chamfer 18 around the top surface 20.

Figure 6:
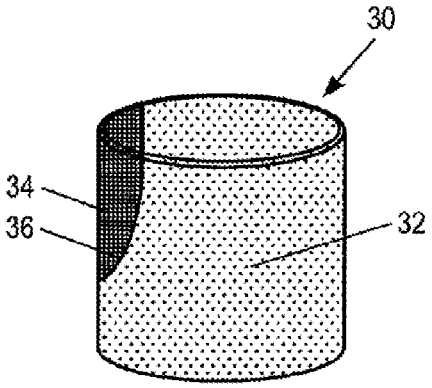
FIG. 6 shows a top perspective view of a cutting element according to a third embodiment of the invention.

The first embodiment of FIGS. 1-3 includes two superabrasive material portions 14. Having two superabrasive material portions can enable re-use of the cutting element by debrazing-brazing the cutting element such that the non-worn superabrasive material portion is brought into contact with the material to be cut. However, where re-use is either not desired or not feasible, other embodiments include only one superabrasive material portion. The third embodiment illustrated in FIG. 6 is such an embodiment, where the cutting element 30 includes a substrate 32 and only one superabrasive material portion 34 with a single interface 36. Note that the embodiment of FIG. 6 is similar to the first and second embodiments except for having only one superabrasive material portion 34 as opposed to two.

Figure 7:
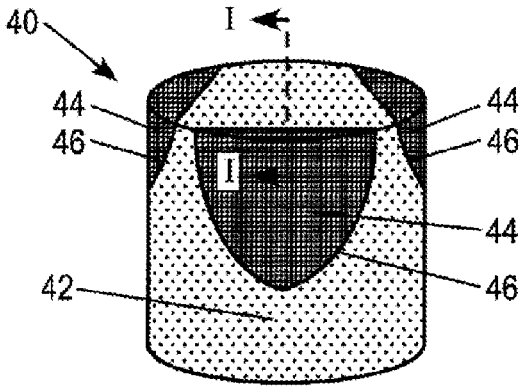
FIG. 7 shows a top perspective view of a cutting element according to a fourth embodiment of the invention.

In other embodiments, the cutting element includes more than two superabrasive material portions. When there is more than one superabrasive material portion, the portions can be distributed in any possible pattern. In certain embodiments, the portions are distributed evenly around the peripheral surface of the cutting element. For example, where there are two superabrasive material portions, the portions are on opposing portions of the peripheral surface of the cutting element, as illustrated in FIGS. 1-5. Further, in a fourth embodiment as illustrated in FIG. 7, there are three superabrasive material portions 44 joined at three interfaces 46 to the substrate 42 of a cutting element, each superabrasive material portion 44 is 120° apart around the peripheral surface of the cutting element. Even distribution can enable more uniform wear in re-use applications, because of the indexability enabled. More than three superabrasive material portions may also be used, with the limit on the number of superabrasive material portions being at least partially dependent on the size of the cutting element and the size of the potential wear surface during use.

Figure 7A:
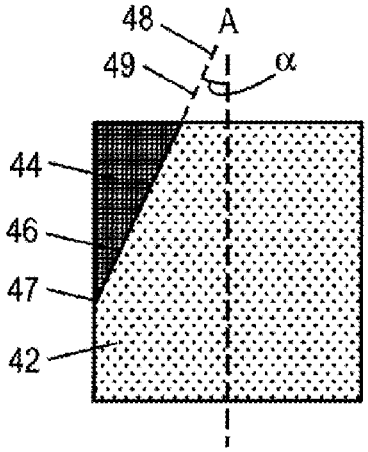
FIG. 7A shows a cross-section of the cutting element of FIG. 7 cut along line I-I.

Further, FIG. 7A illustrates the cross-section of the cutting element of FIG. 7 cut along line I-I. FIG. 7A illustrates the slope angle $\alpha$ as it was defined for the first embodiment, as the least possible angle between a line 49 contained in the slope plane and the longitudinal axis A. The line 49 is similarly defined as in the first embodiment. Also similar to the first embodiment, slope line 48 is defined with respect to the slope line start point 47, and forms a slope line angle that is equal to the slope angle.

In further embodiments, the cutting element includes a single superabrasive material portion with one or more downwardly sloping interface portions. In this manner, the single superabrasive portion may cover the entire top surface of the cutting element or at least the center portion of the top surface of the cutting element.

Figure 8:
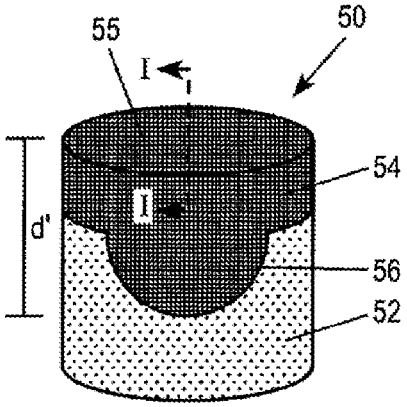
FIG. 8 shows a top perspective view of a cutting element according to a fifth embodiment of the invention.

For example, the fifth embodiment in FIG. 8 illustrates a cutting element 50 including a superabrasive material portion 54 that covers the entire top surface 55 of the cutting element. The superabrasive material portion 54 is joined to the substrate 52 at interface 56. The interface 56 has one downwardly sloping portion such that the longitudinal peripheral thickness (d'), which is the distance along the peripheral surface 60 of the cutting element from the top surface 55 to the interface 56 is greater than the greatest abrasive material thickness (t') of the superabrasive material portion 54.

Figure 8A:
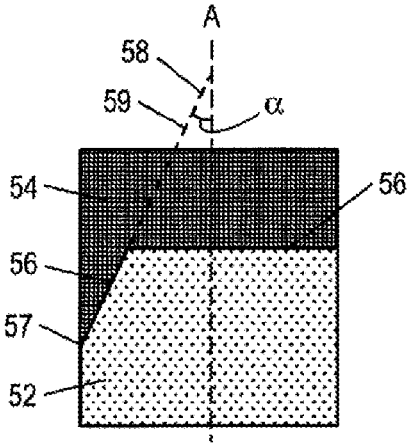
FIG. 8A shows a cross-section of the cutting element of FIG. 8 cut along line I-I.

FIG. 8A illustrates the cross-section of cutting element 50 taken along line I-I in FIG. 8. FIG. 8A further illustrates the slope angle $\alpha$ in the fifth embodiment, which is the least possible angle between a line 59 in a slope plane and the longitudinal axis A. Similar to the first embodiment, the slope plane is the plane that contacts the interface 16 at three non-collinear points, where the substrate 52 is located on only one side of the plane.

Also similar to the first embodiment, the slope line 58 is a line in the cross-section plane taken along line I-I in FIG. 8 starting at slope line start point 57 and also intersecting the interface line 56 such that the substrate is located on only one side of the line. The slope line start point 57 is the point where the superabrasive material 54 has its greatest longitudinal peripheral thickness (d'). Further, like the first embodiment, the slope line angle between slope line 58 and the longitudinal axis A is equal to the slope angle.

Figure 9:
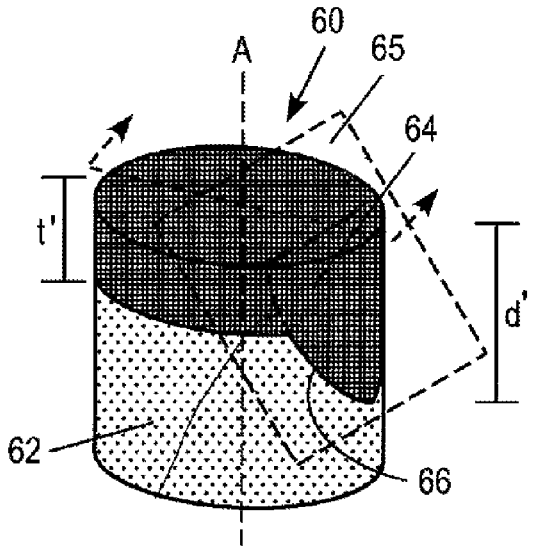
FIG. 9 shows a top perspective view of a cutting element according to a sixth embodiment of the invention that includes a phantom slope plane.
Figure 9A:
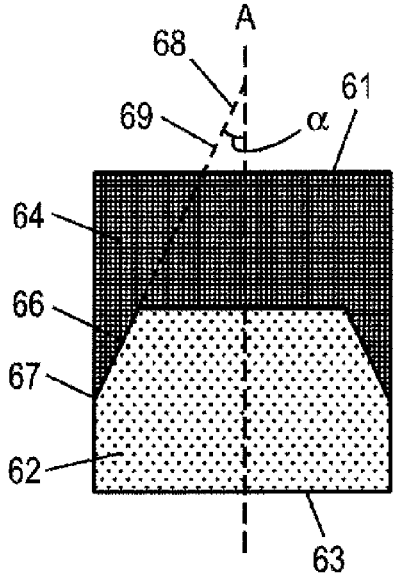
FIG. 9A shows a cross-section of the cutting element of FIG. 9 cut along line I-I.

The sixth embodiment illustrated in FIGS. 9 and 9A includes two downwardly sloping portions of the interface 66 joining the superabrasive material portion 64 and substrate 62. The slope angle $\alpha$ is the least possible angle between the longitudinal axis A and a line 69 in the slope plane 65. Further, a slope line angle equal to the slope angle is formed between the longitudinal axis A and the slope line 68, which is defined in the same manner as for the fifth embodiment in relation to slope line start point 67. The slope angle α can have a value as defined above for the slope angle of previously described embodiments.

Figure 10:
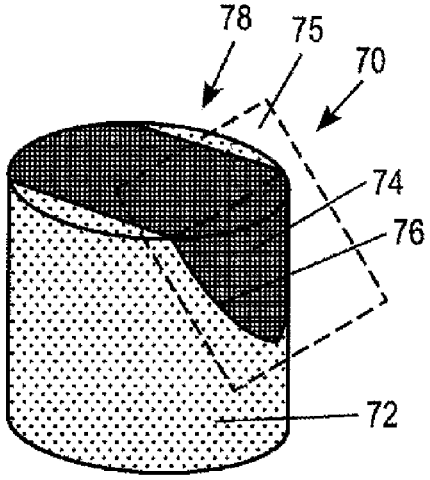
FIG. 10 shows a top perspective view of the cutting element according to a seventh embodiment of the invention that includes a phantom slope plane.

FIG. 10 illustrates a seventh embodiment of a cutting element 70 including a single superabrasive material portion 74 joined to a substrate 72 at an interface 76. This embodiment is similar to the first embodiment, except the superabrasive material portion 74 does not cover the entire top surface 78. Instead, the superabrasive material portion 74 covers the center portion and two side portions of the top surface 78 of the cutting element such that two side portions of the top surface 78 include uncovered substrate.

Figure 11:
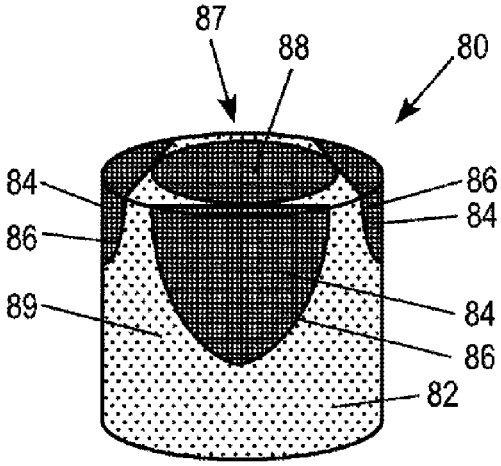
FIG. 11 shows a top perspective view of a cutting element according to an eighth embodiment of the invention.

FIG. 11 illustrates an eighth embodiment of a cutting element 80 including three superabrasive material portions 84 joined to a substrate 82 at interfaces 86, in a manner similar to the embodiment of FIG. 7. The difference from the embodiment of FIG. 7 is that a top surface superabrasive material portion 88 is joined to the top surface 87 of the cutting element. The top surface superabrasive material portion 88 does not extend to any of the peripheral surface 89, and some substrate 82 remains uncovered on the top surface 87 of the cutting element.

FIGS. 12*a*-12*g* illustrate cross-section views of yet further embodiments of cutting elements 90*a-g* including a substrate 92*a-g* joined to superabrasive material portions 94*a-g* and/or 94*a'-f'* at an interface 96*a-g* and/or 96*a'-f'*, respectively. The cutting elements 90*a-g* further include slope angles α, which are the least possible angles between a line 97*a-g* and/or 97*a'* and/or 97*e'* in a slope plane and the longitudinal axis A. The slope planes are established in accordance with the definitions provided for the slope planes of the other embodiments above.

Further, there is a slope line angle between the longitudinal axis A and the slope line 98*a-g* and/or 98*a'* and/or 97*e'*. The slope lines 98*a-g*, 98*a'*, 97*e'* are established in accordance with the definitions provided for the slope lines of the other embodiments above with respect to the slope line start point 95*a-g*, 95*a'*, 95*e'*.

Figure 12E:
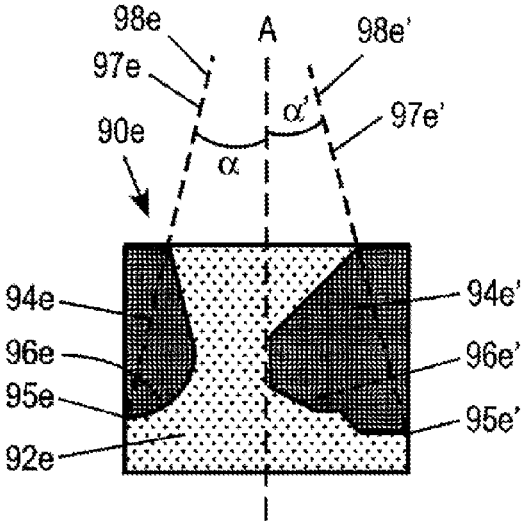
Figure 12F:
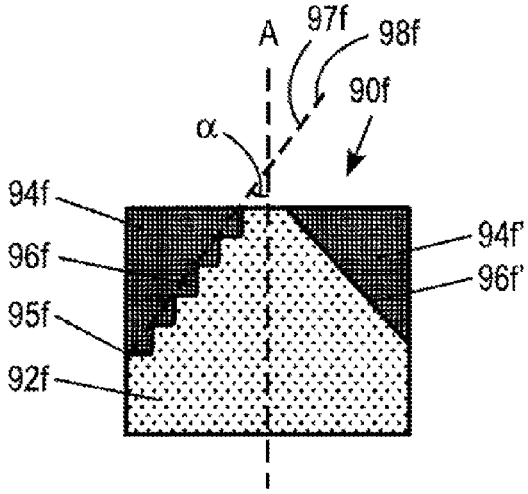
Figure 12G:
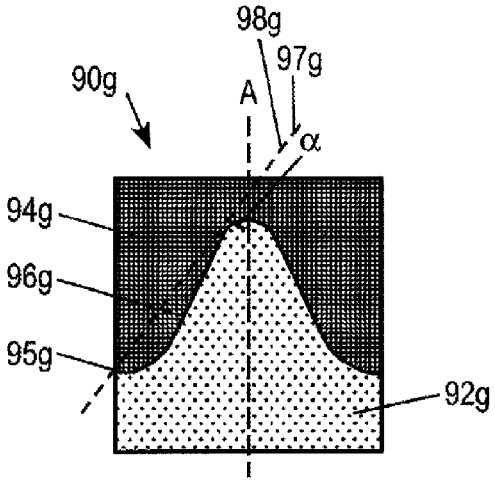

As shown in FIGS. 12*a* and 12*d*, an interface may be planar, wherein the slope line described above is co-planar with the interface itself. As can be seen from FIGS. 12*a*, 12*c*-12*f*, where there are multiple superabrasive material portions in a single cutting element, the portions can have different sizes and shapes. Also, FIG. 12*b* shows that an interface may be planar, where the slope line described above is not co-planar with the interface. This occurs in embodiments where the interface does not intersect the peripheral surface at a point along the peripheral surface where the abrasive material has its greatest longitudinal peripheral thickness. Further, as seen from FIGS. 12*a*, 12*c*-12*g*, a slope angle as defined above can be within the ranges described above, while the interface can have a multitude of different shapes or angles. For example, the interface may be planar, non-planar, curved or a combination thereof. Specific examples include undulating, staircase shaped, and wavy. Further, the interface may include bumps, trenches, patterns, grooves, hills, valleys, walls, protrusions, or combinations thereof. In addition, portions of the interface may include angles relative to the longitudinal axis of the cutting element of any positive, zero, or negative values. The embodiment of FIG. 12*g* has particular interest with regard to stress management within the superabrasive material and its bond to the substrate.

Figure 17:
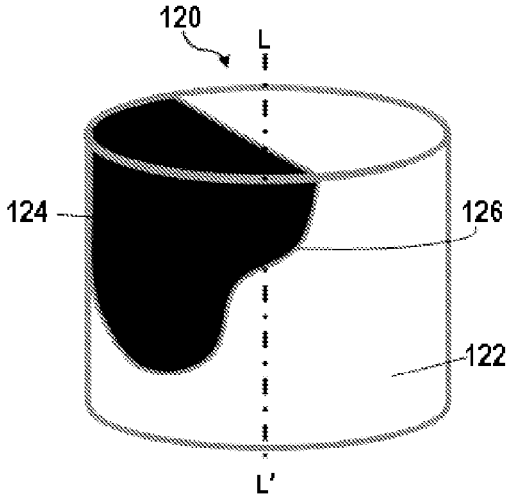
FIG. 17 shows a top perspective view of a cutting element according to a ninth embodiment of the invention.
Figure 17A:
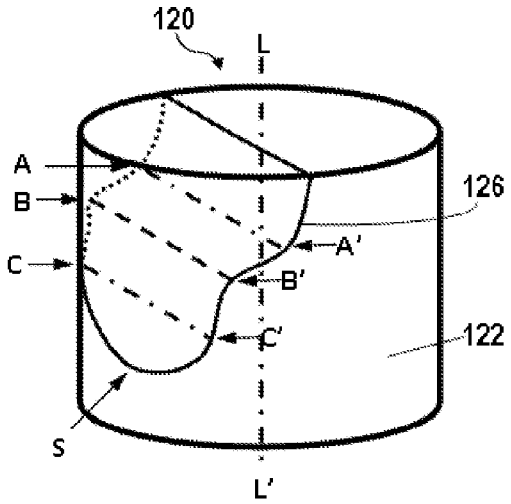
FIG. 17A shows a top wireframe view of the cutting element of FIG. 17.

FIGS. 17 and 17A illustrate a ninth embodiment of a cutting element 120 including a superabrasive material portion 124 joined to a substrate 122 at an interface 126. The interface 126 includes a protruded wave. Such an interface forms more than one slope plane as such a plane is defined above, but only one slope plane includes the least possible angle between a line in a slope plane and the longitudinal axis.

Figure 18:
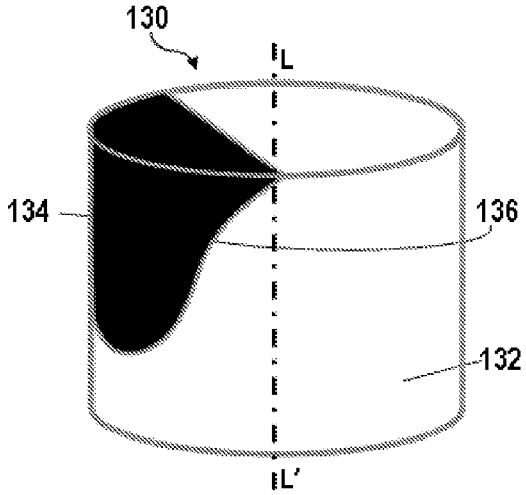
FIG. 18 shows a top perspective view of a cutting element according to a tenth embodiment of the invention.
Figure 18A:
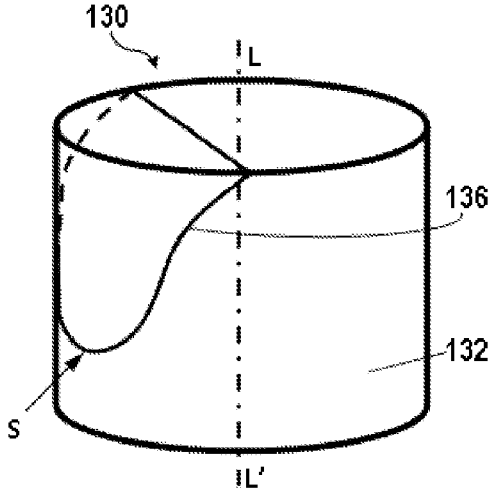
FIG. 18A shows a top wireframe view of the cutting element of FIG. 18.

FIGS. 18 and 18A illustrate a tenth embodiment of a cutting element 130 including a superabrasive material portion 134 joined to a substrate 132 at an interface 136. The interface 136 includes a smooth convex plane or bulging/warping up and no wavy fluctuation or undulation. Such an interface fails to form any slope plane as it is defined above, because there is no plane that contacts the interface at least at three non-collinear points and also has substrate located on only one side of the plane.

Figure 19:
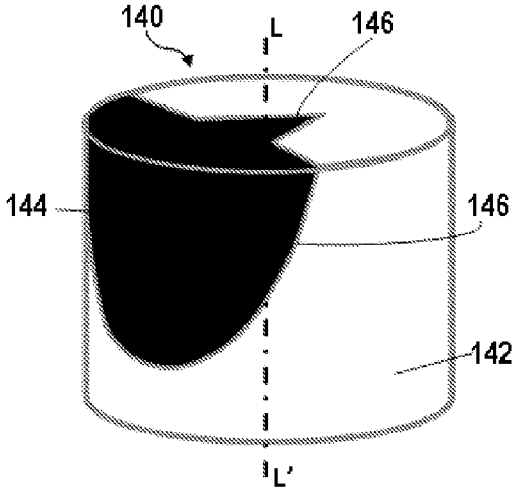
FIG. 19 shows a top perspective view of a cutting element according to a eleventh embodiment of the invention.
Figure 19A:
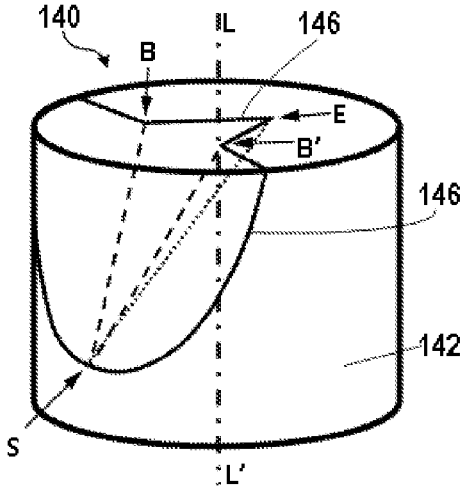
FIG. 19A shows a top wireframe view of the cutting element of FIG. 19.

FIGS. 19 and 19A illustrate an eleventh embodiment of a cutting element 140 including a superabrasive material portion 144 joined to a substrate 142 at an interface 146. The interface 146 includes a groove or trench in the center of the interface that extends past the longitudinal axis of the cutting element 140.

Figure 20:
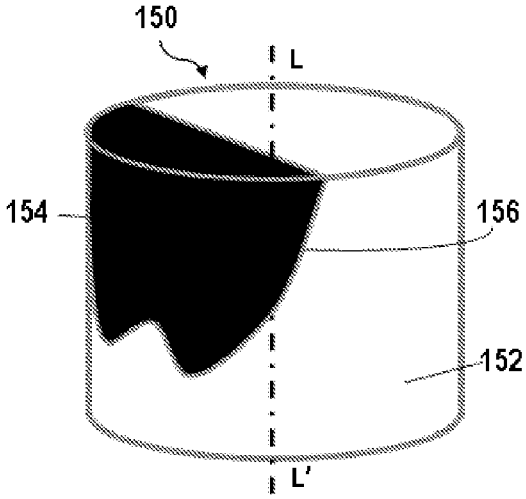
FIG. 20 shows a top perspective view of a cutting element according to a twelfth embodiment of the invention.
Figure 20A:
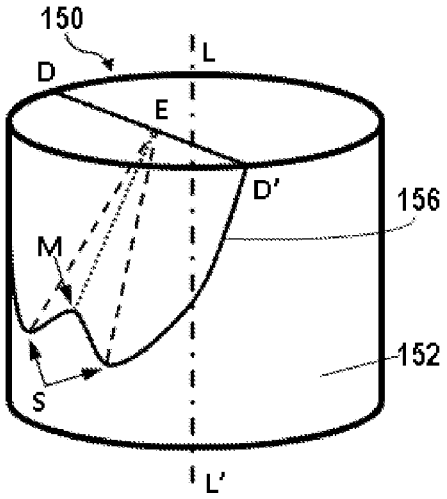
FIG. 20A shows a top wireframe view of the cutting element of FIG. 20.

FIGS. 20 and 20A illustrate a twelfth embodiment of a cutting element 150 including a superabrasive material portion 154 joined to a substrate 152 at an interface 156. The interface 156 is undulating with a ridge running up the center of the interface protruding towards the superabrasive material portion.

Although all of the embodiments illustrated in the Figures are cylindrical cutting elements, the cutting elements can also be polygonal prisms with any desired polygonal shape for the top and/or bottom surfaces. Further, any of the above described elements from any of the above described embodiments can be combined in multiple different combinations to produce further embodiments within the scope of the invention as it is defined by the claims below.

Other alternative embodiments of the present include oval, triangular, square, prismatic, rectangular or other shaped cutting elements. The cutting surfaces may include features such as ribs, protrusions, recesses, buttons, channels, hemispherical, conical, convex and other cutting surface shapes. Also, it is contemplated that the periphery of the cutting surface would have a chamfer. Further, the interfaces between the substrate and the superabrasive material portions may include a variety of mechanical modifications (e.g., ridges, protrusions, depressions, grooves, undulations, or dimples, or chemical modifications) to enhance both the adhesion between the superabrasive material portions and the substrate, as well as the manipulation of stress between the materials employed.

Other embodiments include gradient structures and compositions such as those taught in U.S. Patent Application Publication No. 20080178535 and U.S. Pat. No. 7,316,279.

Cutting elements according to the above mentioned embodiments can be produced by any number of different methods. An exemplary method includes forming a cobalt tungsten carbide cylinder and wire EDM cutting the desired slopes and patterns for the interface to form the carbide stud or substrate. Then, put the carbide stud into a metal cup with the sloped surface up. The metal cup can be formed of Ta, Zr, Mo, Nb, or any other known metal for use as a cup for high pressure high temperature (HPHT) sintering. Load diamond feed into the cup to fill the space between the carbide slopes and the metal cup internal wall. Optionally, the cup may be subjected to vibration or whamming to achieve as high compact density as possible. Put a metal disk on top or crimp the cup to seal the whole assembly and place the assembly into the HPHT sintering process. Finally sinter the assembly according to known HPHT sintering processes. One alternative to the exemplary method include forming the carbide stud with the grooves and dents, bumps, etc. during the pressing and sintering process of the stud so that the cutting step can be eliminated. Another alternative to the exemplary method is to wire EDM cut the superabrasive material to correspond to the wire EDM cut carbide stud, and then bond the superabrasive material to the carbide stud. The HPHT sintering process can subject the assembly to pressures of from about 40 to about 80 kilobars and temperatures of from about 1300° C. to about 1700° C. to sinter and join the substrate and superabrasive material.

EXAMPLES

Example 1

A cutting insert is formed having a substrate formed of cobalt tungsten carbide and a superabrasive material portion formed of polycrystalline diamond. The substrate is formed into a cylinder having a 13 mm outer-diameter. The substrate cylinder is cut by wire EDM cutting along a slope plane where the least possible angle between the longitudinal axis of the cylinder and a line contained within the slope plane is approximately 30°. The cut substrate is then placed into a metal cup with the sloped surface up. Diamond feed is loaded into the cup to fill the space between the carbide slope formed by the cut along the slope plane and the metal cup internal wall. Another metal cup is placed over the first cup, substrate and feed to seal the whole assembly. The assembly is placed into the HPHT sintering apparatus and sintered according to known HPHT sintering processes to sinter and join the cobalt tungsten carbide and polycrystalline diamond. The longitudinal thickness of the diamond table is over 5.5 mm.

Example 2

A cutting insert is formed in the same manner as Example 1, and tested on a new granite rock according to the testing procedures below.

Testing of the Examples and commercially available superabrasive cutting inserts:

A vertical turret lathe (VTL-c) test was performed by subjecting cutting elements of Examples 1 and 2 to granite rock in a surface milling manner. A cutting element was oriented at a 15 degree back rake angle adjacent a flat surface of a Barre Gray Granite wheel having a six-foot diameter. Such formations may comprise a compressive strength of about 200 MPa. The cutting element travels on the surface of the granite wheel at a linear velocity of 400 SFM while the cutting element was held constant at a 0.014 inch depth of cut into the granite formation during the test. The feed is 0.140 inch per revolution along the radial direction. Here the cutting element is subject to flushing water as coolant during the test. Such a VTL test using flushing water as coolant is called VTL-c testing.

Commercially available cutting elements called ARIES, produced by Diamond Innovations, are also formed of cobalt tungsten carbide and polycrystalline diamond. However, the slope angle for the ARIES cutting elements is about 70 degrees as such cutting elements are formed with a polycrystalline diamond layer sintered only on the top surface of a cylindrical cobalt tungsten carbide substrate similar to the cutting insert of FIG. 14. The longitudinal thickness of the diamond table is around 2.1 mm. A standard ARIES cutting element is subjected to the same VTL-c testing method described above for Examples 1 and 2.

Figure 15:
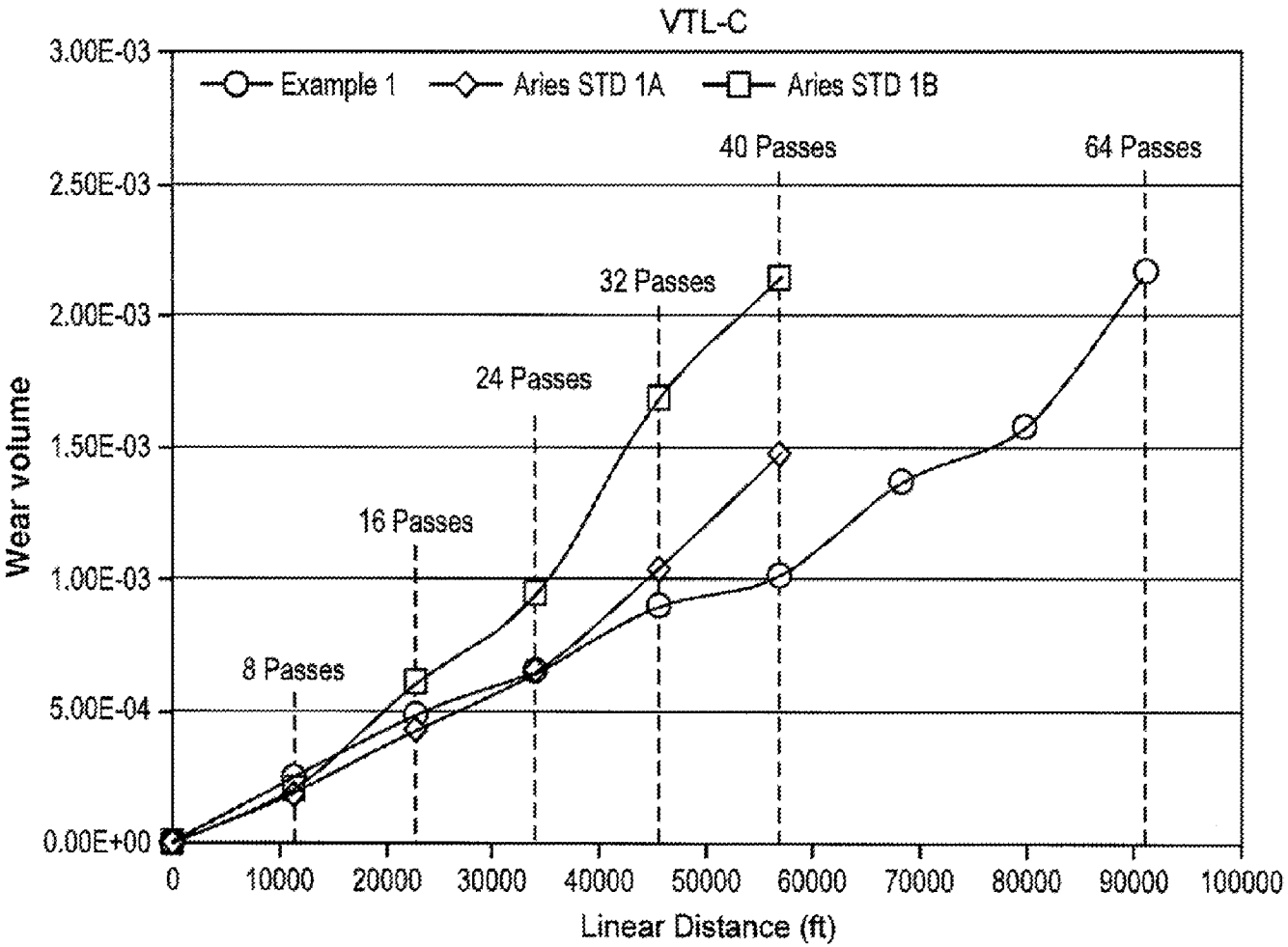
FIG. 15 is a graph depicting results of VTL-c testing.
Figure 16:
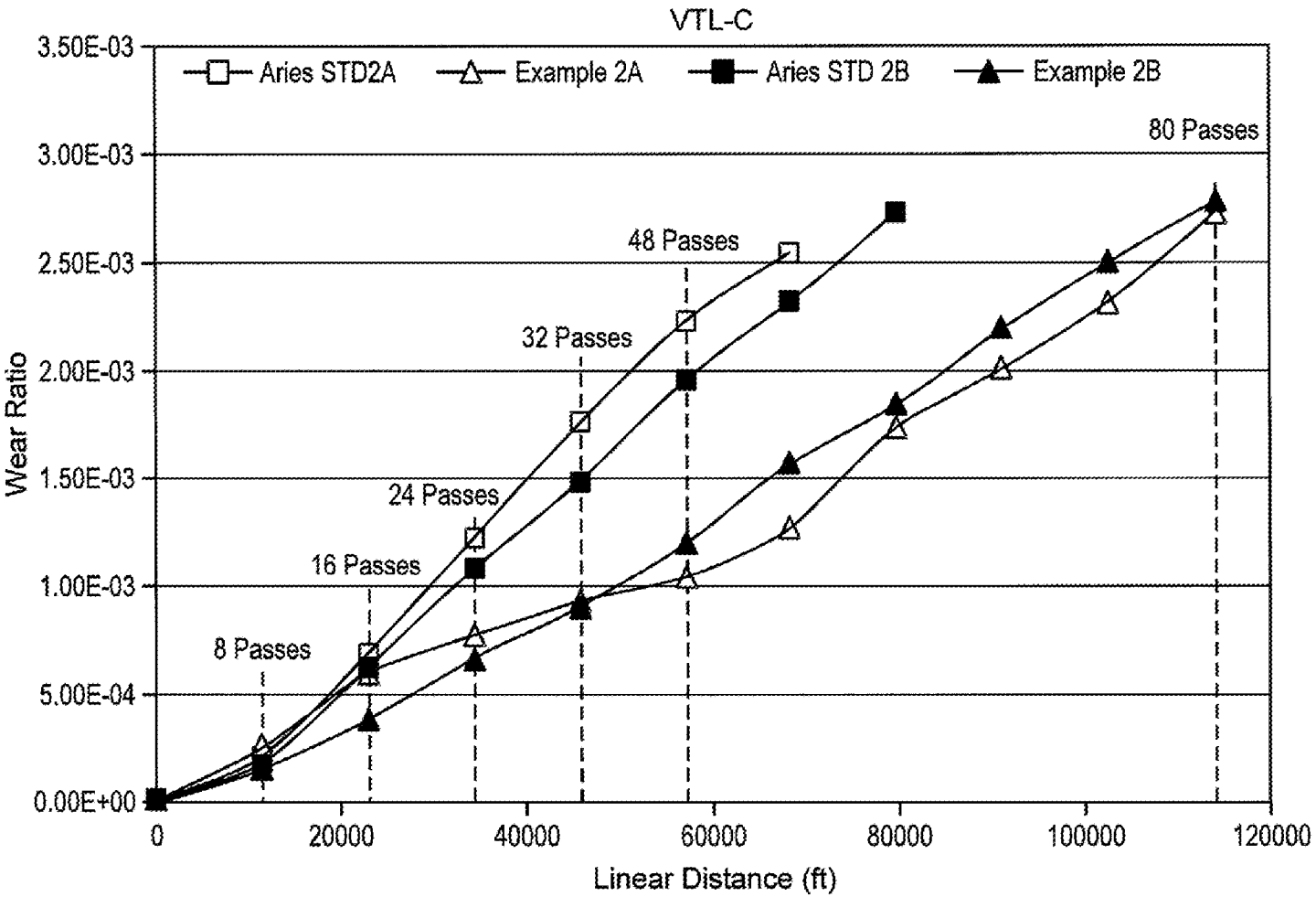
FIG. 16 is a second graph depicting results of further VTL-c testing.

Results of the testing are shown in FIGS. 15 and 16, in which the wear volume versus linear distance of cutting, by the cutting elements, is plotted. In particular, FIG. 15 illustrates how cutting elements in accordance with Example 1 cut a further linear distance before reaching high wear volumes when compared to both test runs (1A and 1B) of a standard ARIES cutting element. Further, an inflection can be seen that around 35,000 linear feet of cutting, when the ARIES cutting elements begin to wear substantially faster per linear distance than prior to that point. In contrast, the cutting element of Example 1 has a much more level wear volume compared to linear distance cut at least until 80,000 linear feet.

FIG. 16 plots wear volume versus linear distance cut for two runs (2A and 2B) of Example 2 and two runs (2A and 2B) of ARIES cutting elements. The cutting elements of Example 2 cut a substantially further linear distance before reaching high wear volume when compared to the ARIES cutting elements. Although described in connection with preferred embodiments thereof, it will be appreciated by those skilled in the art that additions, deletions, modifications, and substitutions not specifically described may be made without departure from the spirit and scope of the invention as defined in the appended claims.

What is claimed is:

1. A cutting element, comprising:

a top surface, a bottom surface, a peripheral surface connecting the top and bottom surface such that the cutting element is cylindrical, and a longitudinal axis passing through the center of the cutting element, at least one superabrasive material portion with knoop hardness >2000, a substrate supporting the at least one superabrasive material portion, the substrate comprising hard metal carbides, and an interface where the at least one superabrasive material portion and the substrate are joined, wherein the interface extends to the peripheral surface, wherein the interface slopes downwardly in relation to the top surface such that the interface forms a slope angle, which is the least possible angle between the longitudinal axis and a line contained within a slope plane, that is less than about 40 degrees;

wherein the slope plane is a plane that contacts the interface at least at three non-collinear points and also has the substrate located on only one side of the plane, or, where there is no plane that contacts the interface at least at three non-collinear points and also has substrate located on only one side of the plane, the slope plane is the tangent plane that incorporates a point along the peripheral surface having the greatest longitudinal peripheral thickness.

2. The cutting element according to claim 1, wherein the slope angle is less than about 35°.

3. The cutting element according to claim 1, wherein the slope angle is from about 5° to about 30°.

4. The cutting element according to claim 1, wherein the slope angle is from about 15° to about 25°.

5. The cutting element according to claim 1, wherein the cutting element comprises at least two superabrasive material portions.

6. The cutting element according to claim 5, wherein the superabrasive material portions are distributed around the peripheral surface of the cutting element.

7. The cutting element according to claim 5, wherein the cutting element comprises at least two superabrasive material portions on opposing portions of the peripheral surface.

8. The cutting element according to claim 1, wherein the cutting element comprises at least three superabrasive material portions.

9. The cutting element according to claim 8, wherein the superabrasive material portions are evenly distributed around the peripheral surface of the cutting element.

10. The cutting element according to claim 1, wherein the entire top surface of the cutting element comprises superabrasive material.

11. The cutting element according to claim 1, wherein at least a portion of the top surface comprises uncovered substrate.

12. The cutting element according to claim 1, wherein the carbide is tungsten carbide.

13. The cutting element according to claim 1, wherein the superabrasive material is PCD.

14. The cutting element according to claim 1, wherein the cutting element is cylindrical.

15. The cutting element according to claim 1, wherein the interface is planar.

16. The cutting element according to claim 1, wherein the interface is non-planar.

17. A shear cutter bit comprising at least one cutting element according to claim 1.

18. The cutting element of claim 1, wherein the interface between the substrate and the superabrasive material portions includes ridges, protrusions, depressions, grooves, undulations, or dimples.

19. The cutting element of claim 1, wherein at least a portion of the interface is planar.

20. A cutting element, comprising:

a top surface, a bottom surface, a peripheral surface connecting the top and bottom surface such that the cutting element is cylindrical, and a longitudinal axis running perpendicular to the top and bottom surface, at least one superabrasive material portion with KHN>2000, a substrate supporting the at least one superabrasive material portion, the substrate comprising hard metal carbides, and an interface where the at least one superabrasive material portion and the substrate are joined, wherein the interface extends to the peripheral surface, and wherein the interface slopes downwardly in relation to the top surface such that the interface forms a slope angle, which is the least possible angle between the longitudinal axis and a line contained within a slope plane, that is less than about 40 degrees, wherein a longitudinal thickness of the at least one superabrasive material portion measured along the peripheral surface of the cutting element in a longitudinal direction is greater than about 3 mm.

21. The cutting element of claim 20, wherein the longitudinal thickness is greater than about 4 mm.

22. The cutting element of claim 20, wherein the longitudinal thickness is greater than about 5 mm.

23. The cutting element of claim 20, wherein a ratio of the longitudinal thickness to the greatest thickness of the superabrasive material portion is greater than about 1.5.

24. A shear cutter bit comprising at least one cutting element according to claim 20.

25. The cutting element of claim 20, wherein at least a portion of the interface is planar.

26. The cutting element of claim 20, wherein the interface is planar.

* * * * *